US006811350B2

(12) United States Patent
Nadasde

(10) Patent No.: US 6,811,350 B2
(45) Date of Patent: Nov. 2, 2004

(54) METHOD AND APPARATUS FOR ADJUSTING THE HEIGHT AND INCLINATION OF ROADWAY AND GREENWAY APPURTENANCES

(76) Inventor: Wayne John Nadasde, 715 Richards Rd., Kelowna (CA), V1X 2X5

( * ) Notice: Subject to any disclaimer, the term of this patent is extended or adjusted under 35 U.S.C. 154(b) by 0 days.

(21) Appl. No.: 10/679,418

(22) Filed: Oct. 7, 2003

(65) Prior Publication Data

US 2004/0071508 A1 Apr. 15, 2004

Related U.S. Application Data

(60) Provisional application No. 60/416,248, filed on Oct. 7, 2002, and provisional application No. 60/456,213, filed on Mar. 21, 2003.

(51) Int. Cl.[7] ..... E02D 29/14
(52) U.S. Cl. ..... 404/26; 52/20
(58) Field of Search ..... 404/25, 26; 52/19, 52/20

(56) References Cited

U.S. PATENT DOCUMENTS

| | | | | |
|---|---|---|---|---|
| 1,076,386 A | * | 10/1913 | O'Day | 404/26 |
| 2,930,295 A | | 3/1960 | Hale | |
| 3,263,579 A | | 8/1966 | Dorris | |
| 3,392,640 A | | 7/1968 | Zeile | |
| 3,773,428 A | | 11/1973 | Bowman | |
| 3,858,998 A | | 1/1975 | Larsson et al. | |
| 3,930,739 A | | 1/1976 | Larsson et al. | |
| 4,038,789 A | | 8/1977 | Axgarde et al. | |
| 4,273,467 A | | 6/1981 | Cronk | |
| 4,618,464 A | * | 10/1986 | Ditcher | 264/35 |
| 4,925,337 A | | 5/1990 | Spiess et al. | |
| 4,976,568 A | * | 12/1990 | Hess | 404/26 |
| 5,205,668 A | * | 4/1993 | Adams | 404/26 |
| 5,344,253 A | * | 9/1994 | Sacchetti | 404/26 |
| 5,628,152 A | | 5/1997 | Bowman | |
| 5,941,025 A | | 8/1999 | Chang | |
| 5,974,741 A | | 11/1999 | Fukuhara | |
| 6,007,270 A | * | 12/1999 | Bowman | 404/25 |
| 6,161,985 A | * | 12/2000 | Hinkle et al. | 404/26 |
| 6,179,518 B1 | | 1/2001 | Suatac | |
| 6,371,687 B1 | | 4/2002 | Heintz et al. | |
| 6,435,764 B1 | * | 8/2002 | McNeely | 404/26 |
| 6,524,026 B2 | * | 2/2003 | Sondrup | 404/26 |

FOREIGN PATENT DOCUMENTS

| | | |
|---|---|---|
| CA | 990115 | 6/1976 |
| CA | 1068961 | 1/1980 |
| CA | 2229417 | 2/1997 |
| CA | 2317317 | 2/2002 |
| WO | WO 97/07287 | 2/1997 |

* cited by examiner

*Primary Examiner*—Robert E. Pezzuto
*Assistant Examiner*—Alexandra Pechhold
(74) *Attorney, Agent, or Firm*—Antony C. Edwards

(57) ABSTRACT

An apparatus for adjusting the height and inclination of roadway and greenway appurtenances includes a rigid annular spacer ring sized so as to be mountable onto a manhole, and a manhole riser mountable onto the spacer ring. The riser substantially frusto-conically shaped. A rigid annular base flange may be mounted around a base end of the riser. A plurality of threaded bores are formed in spaced array around the base flange. Rigid elongate threaded members are threadably mountable into the threaded bores so as to be selectively threadably adjustable in the threaded bores and so as to protrude downwardly from the base flange into engagement, beneath the riser, with a top surface of the spacer ring when the riser is mounted on the spacer ring. The threaded members are threadably adjustable in the threaded bores to elevate or to tilt the riser relative to the spacer ring.

18 Claims, 7 Drawing Sheets

METHOD AND APPARATUS FOR ADJUSTING THE HEIGHT AND INCLINATION OF ROADWAY AND GREENWAY APPURTENANCES

CROSS REFERENCE TO RELATED APPLICATION

This application claims priority from U.S. Provisional Patent Application No. 60/416,248 filed Oct. 7, 2002 and U.S. Provisional Patent Application No. 60/456,213 filed Mar. 21, 2003 entitled Method and Apparatus for Adjusting the Height and Inclination of Roadway and Greenway Appurtenances.

FIELD OF THE INVENTION

This invention relates to the field of devices for adjusting the elevation of manhole covers, catch basin frames or other appurtenances relative to a roadway or greenway surface or the like, and in particular to the use of set screws for adjusting the angular relation of manhole cover risers or other appurtenances in relation to a concrete substrate such as spacers mounted atop a conventional manhole.

BACKGROUND OF THE INVENTION

Many municipalities may now enforce quite close tolerances in road construction that require the installed manhole cover once mounted onto the manhole cover riser, to be substantially flush with the roadway surface, that is, the surface of the asphalt. For example, in applicant's experience, at least one municipality requires that the manhole cover be parallel to the asphalt surface and offset from the asphalt surface no more than seven millimetres.

Because the manhole apertures themselves are horizontal, and often the road grade is not horizontal, for example having a grade of up to four percent, or in extreme cases a twelve percent grade and/or a seven percent crossfall, it is conventional that, firstly, a ring or annular spacer, sometimes referred to as a "donut", is installed onto the manhole aperture, and then a manhole cover riser is mounted on top of the ring spacer. Because the manhole cover risers are very heavy, being constructed of solid metal such as grey or ductile iron, it is often a two-man lift to set the riser onto the ring spacer and then a two-man job to adjust the tilt or incline of the riser on top of the spacer. Typically what is done is one man lifts one side or edge of the riser while the second man inserts makeshift shims, including whatever small pieces of wood or rocks may be to hand, so as to adjust the angular relation of the riser onto the horizontal upper surface of the spacer. In this fashion, the riser is adjusted both vertically and tilted relative to the spacer so as to bring the upper surface of the riser into which the manhole cover fits within the specified tolerances of the anticipated upper surface of the asphalt.

Once a riser has been so adjusted, the roadway construction continues around the riser, for example, as the crush is compacted. This may result in the riser being disturbed before the riser and spacer are encased in concrete so as to leave the riser out of adjustment because of disruption to the shims. This then means that the riser must again be adjusted either before or after the asphalt is laid. Thus, as may be seen, the prior art method of adjusting the manhole cover risers is both labour intensive and prone to later misalignment requiring the adjustment work to be redone.

Therefore there exists a need in the prior art for a simple to install, easily adjustable mechanism for adjusting the vertical height of a manhole cover riser above the concrete ring spacer and for adjusting the angular inclination of the riser relative to the ring spacer.

SUMMARY OF THE INVENTION

The present invention is an apparatus for adjusting the height above, and angular relation of a roadway or greenway appurtenance such as a manhole cover riser relative to a substrate such as an annular concrete spacer for mounting atop a manhole aperture. In the case of a riser, the present invention may include a frusto-conical hollow center riser portion having an annular rim rigidly mounted around or atop thereof for receiving a manhole cover concentrically mounted into the upper surface of the rim, and having concentrically base-mounted therearound a base flange, which may be circular or square or any other shape in planform, of a diameter corresponding to the diameter of the annular spacer. At least two and preferably at least three or four get screws or other threaded members included without intending to be limiting cone-point set screws are threadably mounted through the annular flange. Each threaded set screw is threadably mounted to a corresponding threaded bore vertically bored through the base flange. The threaded bores may be equally radially spaced around the base flange about the vertical axis of symmetry of the riser and the coaxial axis of symmetry of the spacer when assembled with the riser.

Each of the set screws may be independently adjusted by being rotated in their threaded engagement in the threaded bores, for example by the use of a tool having a male coupling end releasably engaged into a corresponding female receptacle in the upper ends of the set screws. Rotation of the screws adjusts the distance the set screws protrude from the bottom of the base flange. The lowermost ends of the set screws engage the upper surface of the annular spacer so as to frictionally engage and mate the riser onto the spacer. The engagement of the set screws thereby inhibits lateral movement of the riser relative to the spacer. Each of the set screws may be adjusted in relation to the base flange so that the upper surface of the riser is brought into parallel, substantially flush, relation with the upper surface of the roadway being built. Female mating means may be provided, for example on the spacer, for mating and anchoring of other ends of the set screws. For example an annular groove or channel or segment thereof or other female receivers such as sleeves, collars, cups etc. may be provided on the upper surface of the spacer or a mating seating ring sandwiched between the spacer and the riser.

Advantageously, the tool for adjusting the set screws is a common tool, for example a wrench or key-type tool such as a T-handle allen-key.

In summary the apparatus according to the present invention for adjusting the height and inclination of roadway and greenway appurtenances includes a rigid annular spacer ring sized so as to be mountable onto a manhole, and a manhole riser mountable onto the spacer ring. The riser substantially frusto-conically shaped. A rigid annular base flange may be mounted around a base end of the riser. A plurality of threaded bores are formed in spaced array around the base flange. Rigid elongate threaded members are threadably mountable into the threaded bores so as to be selectively threadably adjustable in the threaded bores and so as to protrude downwardly from the base flange into engagement, beneath the riser, with a top surface of the spacer ring when the riser is mounted on the spacer ring. The threaded members are threadably adjustable in the threaded bores to elevate or to tilt the riser relative to the spacer ring. An annular retaining ring may be provided which is mountable in mating engagement, so as to be sandwiched between, the riser and the spacer ring. The base flange substantially overlaps the top surface of the spacer ring, or retainer ring if employed, when mounted thereon. The plurality of threaded bores may be at least three threaded bores in substantially equally radially spaced array around the base flange. The retaining ring may include at least one retaining flange mounted so as to extend outwardly of the retaining ring for engaging the top surface of the spacer ring when the retaining ring is mounted thereon and for alignment under the threaded bores when the riser is mounted on the retaining ring. The retaining ring may have a lower rim for mating inside the spacer ring and an upper rim sized to engage an inner surface of the riser so as to space and center the riser above and over the retaining flange before the threaded members are engaged with the retaining flange. The upper rim may be flared outwardly.

Female retaining means may be mounted on the at least one retaining flange for mating with lowermost ends of the threaded members. The female retaining means may be at least one corresponding length of channel in a top surface of the at least one retaining flange. The length of channel may be an annular groove and the at least one retaining flange may be an annular flange extending around the retaining ring.

Preferably, the lowermost ends of the threaded members are not concave. For example, advantageously the lowermost ends of the threaded members are bullet-shaped and the female retaining means mate substantially conformably, that is, so as to conform with, the shape of the lowermost ends. In one embodiment the threaded members are set screws. Protective caps or other protective means may be provided for snug mounting or application onto the uppermost ends of the threaded members.

The method of the present invention for adjusting the height and inclination of roadway and greenway appurtenances includes the steps of:

a) mounting onto a manhole opening a rigid annular spacer ring sized so as to be mountable onto the manhole, b) mounting a manhole riser onto the spacer ring, wherein the riser is substantially frusto-conically shaped and has a rigid annular base flange mounted around a base end of the riser, a plurality of threaded bores formed in spaced array around the base flange, c) threading rigid elongate threaded members into the threaded bores and selectively threadably adjusting the threaded members in the threaded bores so as to protrude downwardly from the base flange and engage a top surface of the spacer ring, d) adjusting the threaded members in the threaded bores to elevate or to tilt the riser relative to the spacer ring.

The method may also include mounting an annular retaining ring in mating engagement sandwiched between the riser and the spacer ring.

DETAILED DESCRIPTION OF EMBODIMENTS OF THE INVENTION

Figure 1:
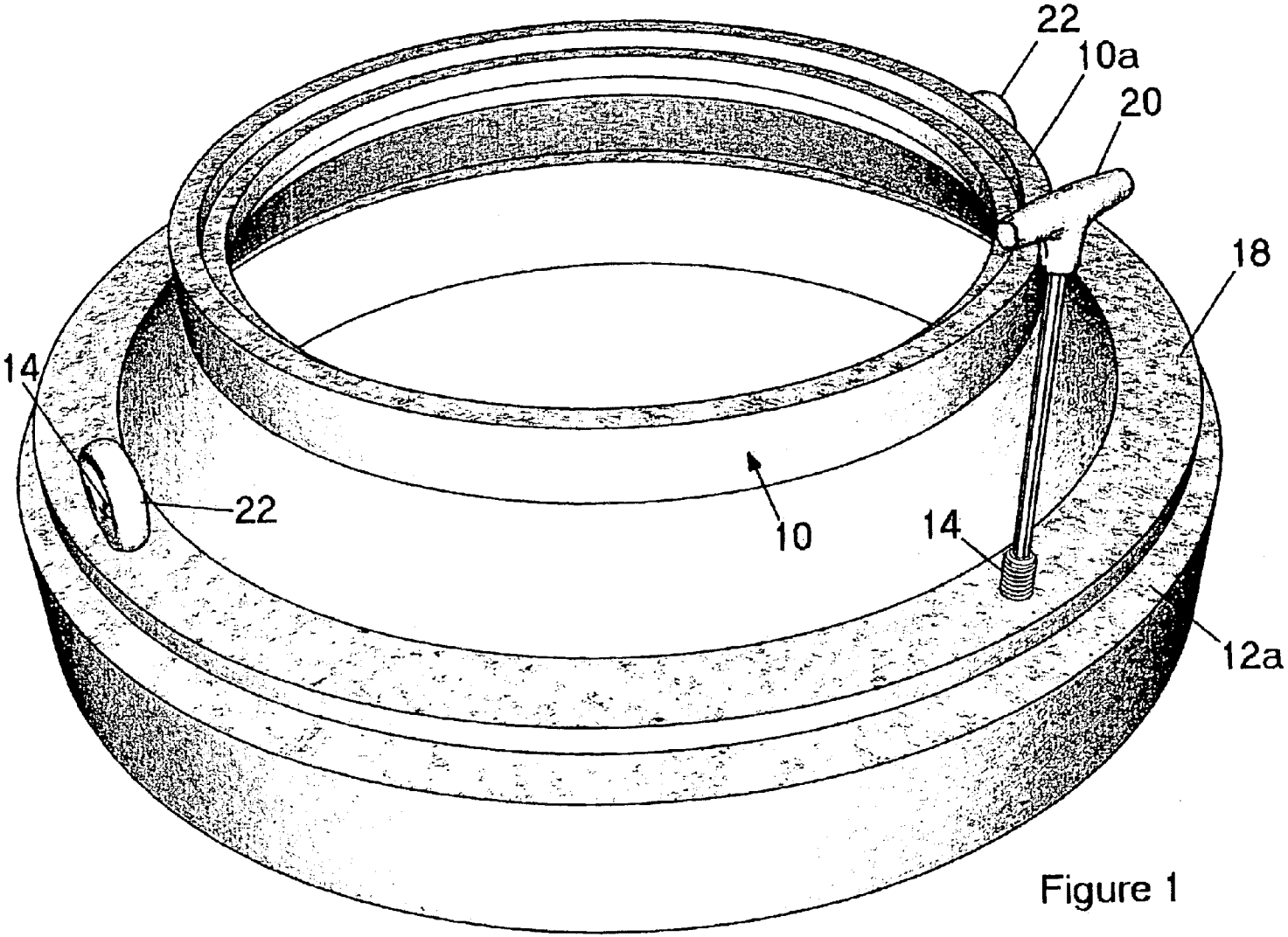
FIG. 1 is, in perspective view, a manhole cover riser according to the present invention mounted atop a concrete ring spacer.
Figure 2:
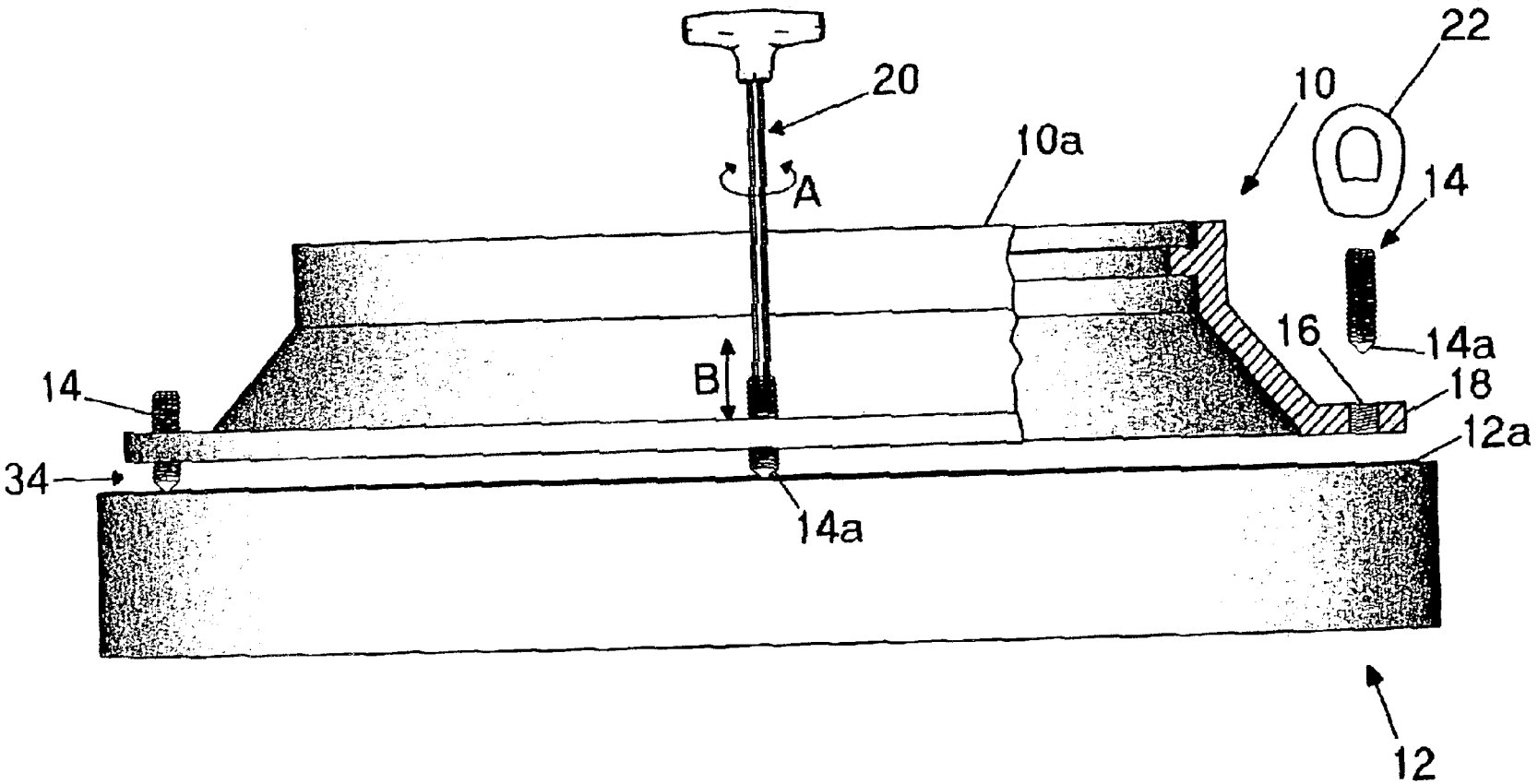
FIG. 2 is, in partially cut away, partially exploded side elevation view, the riser and ring spacer of FIG. 1.

In what follows reference is made to drawings wherein similar characters of reference denote corresponding parts in each view. Thus as seen in FIGS. 1 and 2, manhole cover riser 10 is adjustably mounted atop annular concrete spacer 12 by the threading of threaded set screws 14 through threaded vertical bores 16 in the base flange 18 of riser 10. Reference herein to use of set screws 14 is also intended to the alternative use of other elongate members, one advantage of the use of set screws being however that they may be screwed down into the bores 16 until their ends are entirely within the bores thereby allowing an extra, albeit small, range of travel.

In one embodiment not intended to be limiting, a plurality of at least two, and preferably three or more set screws 14 are threadably mounted through corresponding vertical bores 16 for example in equally radially spaced array equi-distant apart around base flange 18. Riser 10 and base flange 18 is sized so that set screws 14, when threaded through bores 16, engage the horizontal upper surface 12*a* of spacer 12, as seen in the embodiment of FIG. 1. The ends 14*a* of set screws 14, illustrated to be cone-points although this is not intended to limiting, the ends preferably not being concave but rather being blunt ended, bullet-ended or point-ended, indent or frictionally engage or bite into, so as to in all instances frictionally engage, riser 10 onto spacer 12 to inhibit any lateral movement of riser 10 relative to the spacer.

Advantageously, the upper end of each set screw 14 is adapted to receive a common torqueing tool in mating engagement thereon. In the illustrated embodiment, the upper end of set screws 14 are adapted with female allen-key type apertures for mating engagement with T-handle allen-key tool 20. Thus with tool 20 mated into the upper end of set screws 14 and set screws 14 threadably mounted into vertical bores 16, rotation of tool 20 in direction A correspondingly rotates the set screw to which it is mounted so as to adjust that set screw in direction B relative to flange 18. In this fashion, each set screw 14 may be independently adjusted so as to adjust both the vertical height of the riser relative to the spacer and to adjust the angular inclination or tilt of the riser relative to the spacer thereby allowing a single workman to adjust the riser, probably only once, and without the help of a second workman.

The use of set screws 14 mounted into threaded bores 16 also provides the opportunity for the use of mechanical assistance in lifting and placing a riser 10 onto a spacer 12. Thus for example as seen in FIG. 1, rigid eyes 22 are threadably mounted onto the exposed upper ends of set screws 14. A lifting harness, or chain or sling or the like (not shown) may thus be attached to a pair of eyes 22 mounted onto an oppositely disposed pair of set screws 14 to provide for the mechanical lifting of riser 10 into place on top of spacer 12. Once the riser has been placed onto the spacer, a single workman may adjust the height and tilt of the riser on the spacer by engaging the ends 14*a* of set screws 14 with upper surface 12*a* of spacer 12 using tool 20. The height and tilt of the riser may thus be adjusted so as to bring the upper surface 10*a* of the riser within the required tolerances generally flush with the anticipated upper surface of the roadway.

Figure 3:
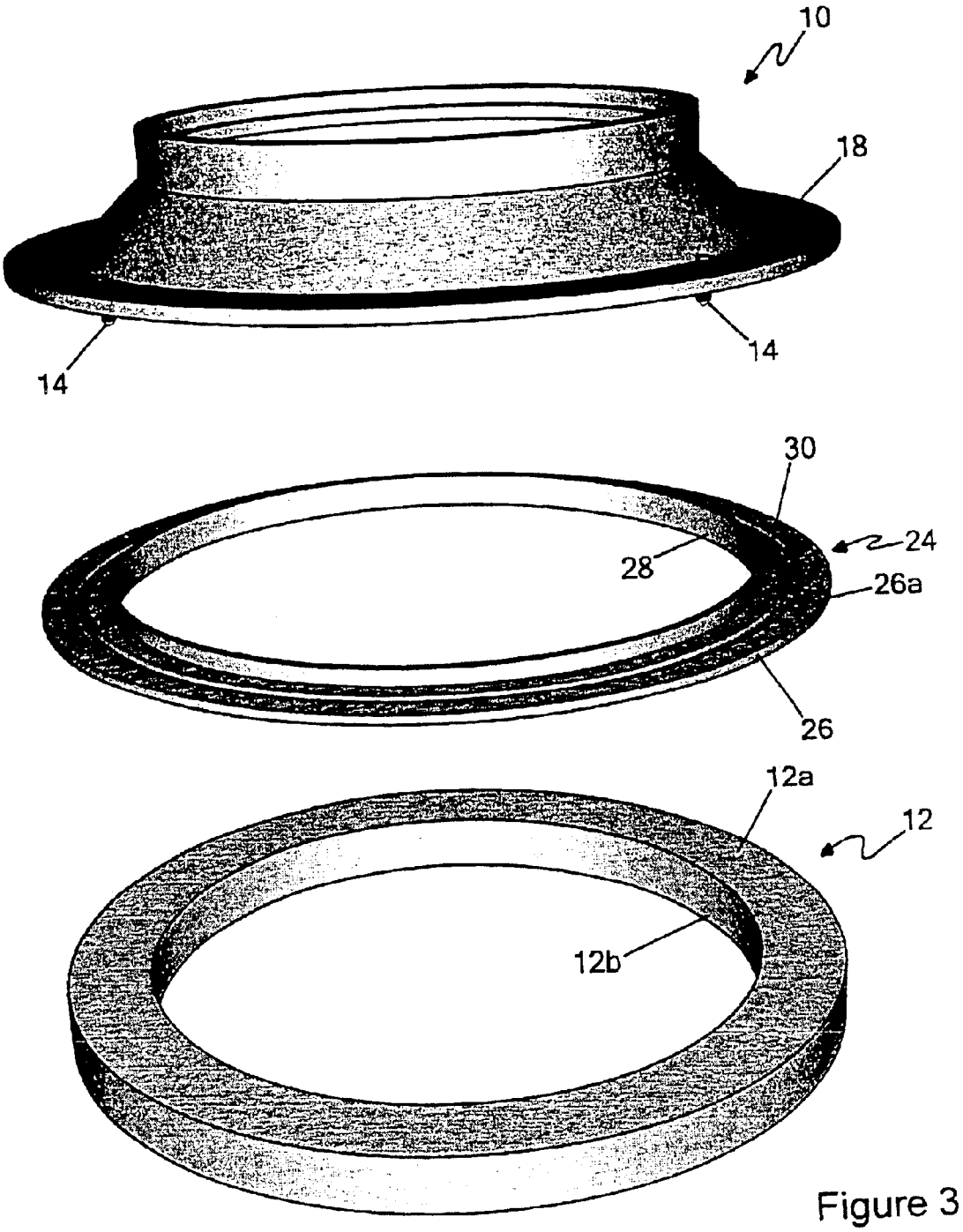
FIG. 3 is, in exploded perspective view, an alternative embodiment of the manhole cover riser according to the present invention.
Figure 4:
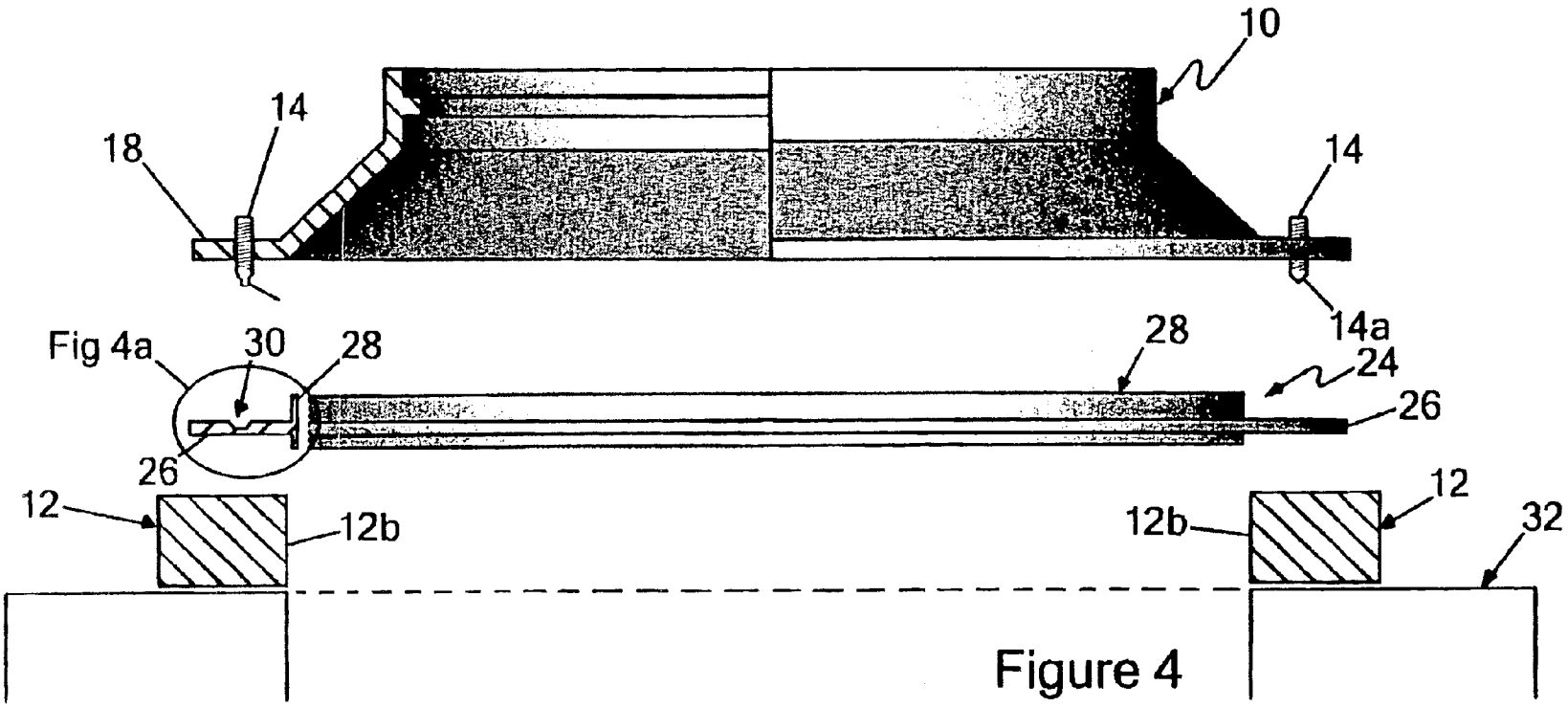
FIG. 4 is, in partially cutaway exploded view, the embodiment of FIG. 3.
Figure 4A:
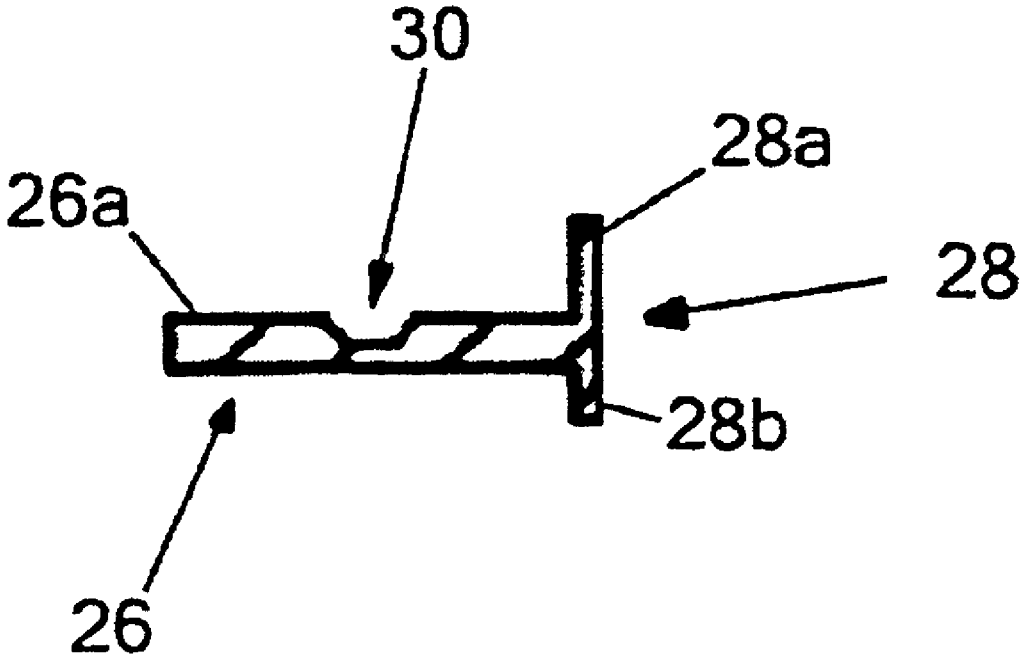
FIG. 4*a* is an enlarged view of a portion of FIG. 4.

In a further embodiment such as seen in FIGS. 3 and 4, a seating ring 24 is provided for mounting between riser 10 and spacer 12. Seating ring 24 has a horizontal annular flange 26 for seating down onto the upper surface 12*a* of spacer 12, and a vertical collar 28 mounted around the inner circumference of annular flange 26, sized for snug seating within the annular inner surface 12*b* of spacer 12. Collar 28 extends vertically downwardly from flange 26 for mating with inner surface 12*b*, and extends vertically upwardly from flange 26 for mating into the frusto-conical inner surface 10*b* of riser 10. In particular, upstanding rim portion 28*a* as better seen in FIG. 4*a* is sized so as to snugly mate up against inner surface 10*b* when riser 10 is mounted onto seating ring 24 to thereby assist in centering of riser 10 onto the seating ring. Thus, with lower rim 28*b* of collar 28 seated within inner surface 12*b*, riser 10 may be lowered down onto collar 28 whereupon upper rim 28*a* assists in centering inner surface 10*b*, and thereby riser 10, onto seating ring 24 so as to bring the lower ends of set screws 14 into mating engagement within a correspondingly sized annular groove 30 formed in the upper surface 26*a* of annular flange 26. In this embodiment then the lower ends 14*a* of set screws 14 need not be pointed, but rather, may have blunt squared-off ends or bullet-shaped ends for snug mating into annular groove 30. Movement of riser 10 relative to spacer 12 once riser 10 has been installed is thereby inhibited so as to increase the likelihood of maintaining the correct vertical alignment of riser 10 over manhole 32 up until and during the pouring of concrete around the riser and spacer.

The use of seating ring 24, and in particular the use of upper rim 28*a* of collar 28, maintains the elevation of riser 10 an appropriate distance above flange 26 and spacer 12 to thereby improve the consistent insertion of the concrete into the space 34 between the riser and the seating ring, upper rim 28*a* also serving to block concrete being forced into space 34 from extending into or falling into the manhole opening.

Figure 5:
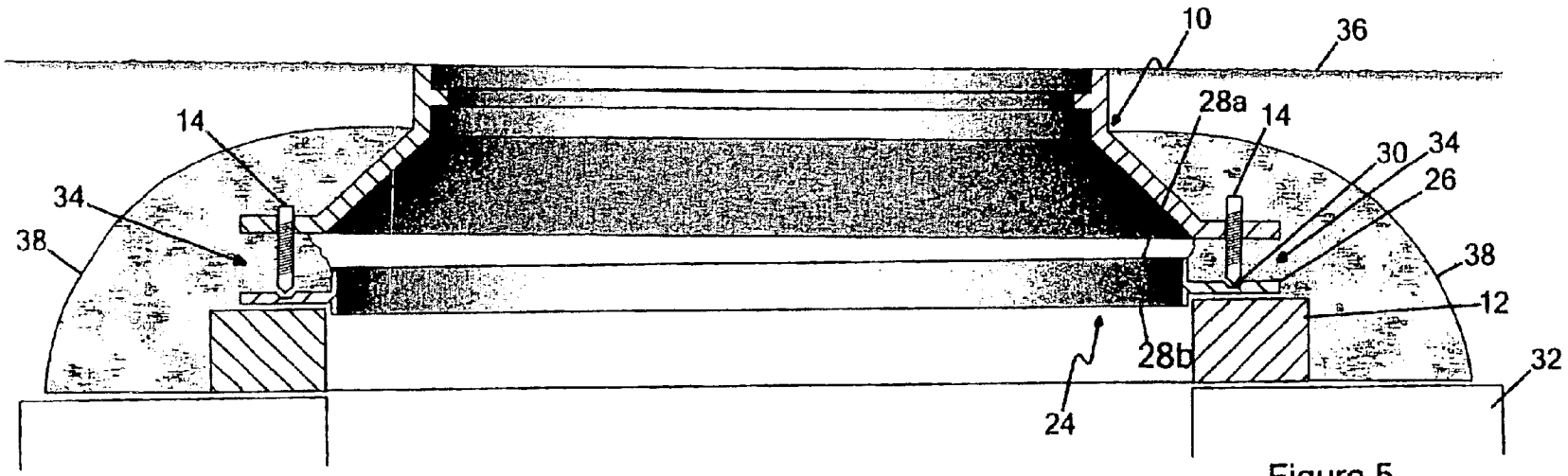
FIG. 5 is a cross section through the assembled and installed manhole cover riser of FIG. 4.

FIG. 5 illustrates the manhole cover riser of FIG. 4 assembled and installed underneath roadway pavement 36, secured in place by concrete 38. Riser 10 is slightly inclined at one side by the use of set screws 14 so that the top of the riser is flush with the inclination of the pavement 36. Rim 28*a* services to prevent incursion of concrete 38 forced into space 34 spilling into the riser, spacer and manhole 32.

Figure 6:
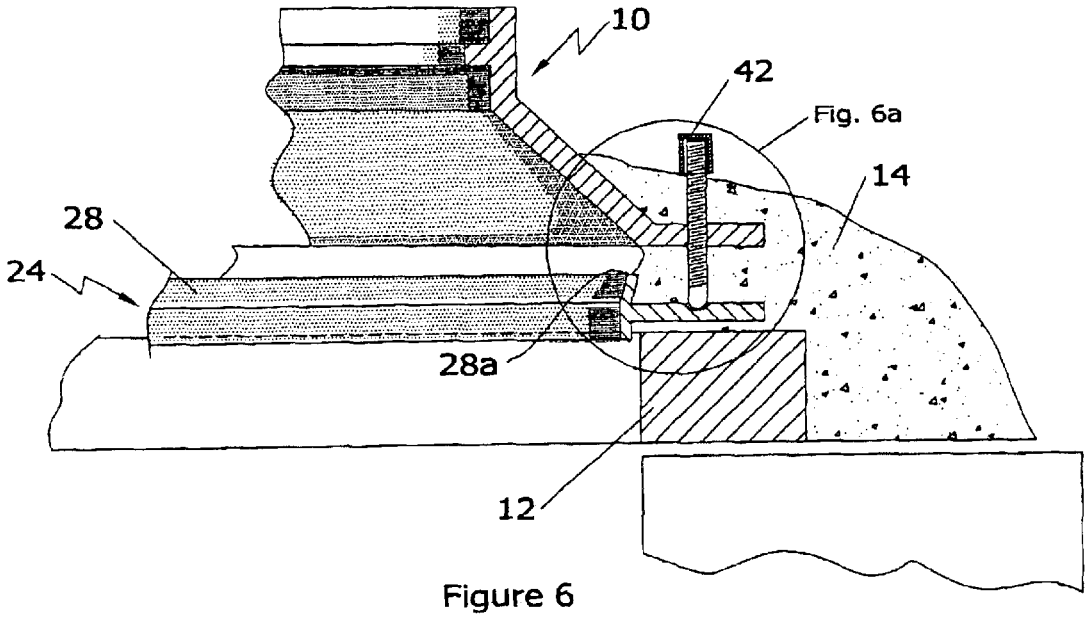
FIG. 6 is a view in a vertical cross section of a seating ring and set screw according to an alternative embodiment of the present invention.

As may be seen in FIGS. 6 and 6*a*, set screws 14 may protrude above concrete cap 38 permitting later vertical readjustment of the height or angle of seating ring 24 prior to paving. The exposed threaded portion of set screws 14 and the allen-key type recess at the end of the screw may be protected by a soft plastic cap 42 and/or suitable lubricants or other protective means. Seating ring 24 has an upper rim 28*a* which is outwardly flared. As shown in FIG. 6*a* distance A' may be approximately 1 centimeter (0.4 inch). Set screws 14 may have bullet-shaped ends 14*a* that is, oval or hemispherically shaped, such that they do not cut into the surface of groove or recess 30 as is the set screws are turned groove 30 may have a correspondingly concave shaped cross section. If the ends of the set screws do not bite into the base material in groove 30, for example as would happen with point-ended set screws, the possibility is minimized that the riser would "walk" out of its preferred orientation as the set screws are turned.

Figure 6B:
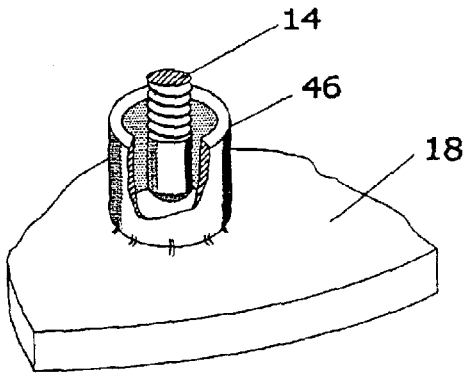
FIG. 6*b* is a partially cut away perspective view illustrating a set screw receiving sleeve on a seating ring according to a further alternative embodiment of the present invention.
Figure 6A:
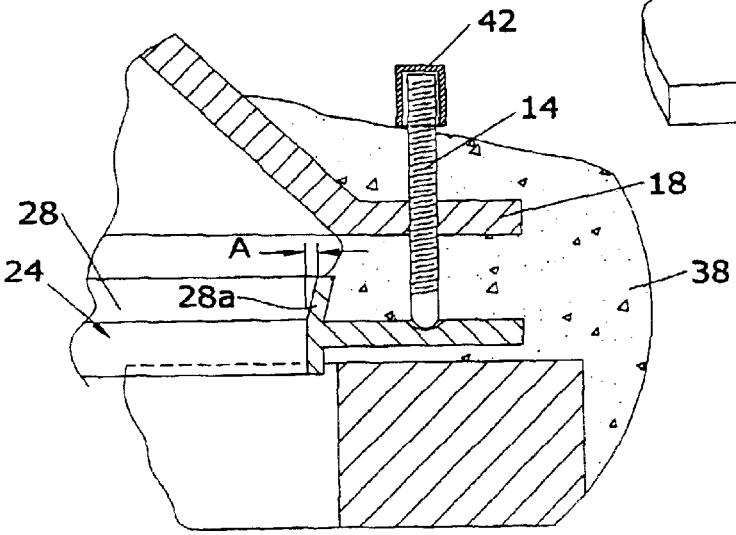
FIG. 6*a* is an enlarged view of a portion of FIG. 6.

In an alternative embodiment as shown in FIG. 6*b* a female receiver such as a collar or sleeve 46 may be rigidly affixed as by welding to flange 26 of seating ring 24 to mate with the corresponding set screw.

As will be apparent to those skilled in the art in the light of the foregoing disclosure, many alterations and modifications are possible in the practice of this invention without departing from the spirit or scope thereof. For example, the set screws may thread through the base flange of a catch basin frame or hood so as to adjust its inclination and elevation, and the adjustment on the appurtenances may be in relation to roadways, or to greens, walkways or other greenways. Accordingly, the scope of the invention is to be construed in accordance with the substance defined by the following claims.

What is claimed is:

1. An apparatus for adjusting the height and inclination of roadway and greenway appurtenances for mounting onto a rigid annular spacer ring sized so as to be mountable onto a manhole, the apparatus comprising:

an annular retaining ring mountable in matins engagement onto the spacer ring, a manhole riser mountable onto said retaining ring so as to sandwich said retaining ring between said riser and the spacer ring, a rigid annular base flange mounted around a base end of said riser, a plurality of threaded bores formed in spaced array around said base flange, rigid elongate threaded members threadably mountable into said threaded bores so as to be selectively threadably adjustable in said threaded bores and so as to protrude downwardly from said base flange into engagement, beneath said riser, with a top surface of said retaining ring when said riser is mounted on said spacer retaining ring, said threaded members threadably adjustable in said threaded bores to elevate or to tilt said riser relative to said ring.

2. The device of claim 1 wherein said base flange substantially overlaps said top surface of said spacer ring when mounted thereon.

3. The device of claim 2 wherein said plurality of threaded bores is at least three threaded bores in substantially equally radially spaced array around said base flange.

4. The device of claim 3 wherein said retaining ring includes at least one retaining flange mounted so as to extend outwardly of said retaining ring for engaging said top surface of said spacer ring when said retaining ring is mounted thereon and for alignment under said threaded bores when said riser is mounted on said retaining ring.

5. The device of claim 4 wherein female retaining means are mounted on said at least one retaining flange for mating with lowermost ends of said threaded members.

6. The device of claim 5 wherein said female retaining means is at least one corresponding length of channel in a top surface of said at least one retaining flange.

7. The device of claim 6 wherein said length of channel is an annular groove and said at least one retaining flange is an annular flange extending around said retaining ring.

8. The device of claim 5 wherein lowermost ends of said threaded members are not concave.

9. The device of claim 8 wherein said lowermost ends are bullet-shaped and wherein said female retaining means mate substantially conformably with said lowermost ends.

10. The device of claim 9 wherein said female retaining means is at least one corresponding length of channel in a top surface of said at least one retaining flange.

11. The device of claim 10 wherein said length of channel is an annular groove and said at least one retaining flange is an annular flange extending around said retaining ring.

12. The device of claim 10 wherein said threaded members are set screws.

13. The device of claim 11 wherein said retaining ring has a lower rim for mating inside said spacer ring and an upper rim sized to engage an inner surface of said riser so as to space and center said riser above and over said retaining flange before said threaded members are engaged with said retaining flange.

14. The device of claim 13 wherein said upper din is flared outwardly.

15. The device of claim 13 further comprising protective caps for snug mounting onto uppermost ends of said threaded members.

16. The device of claim 1 further comprising at least one rigid eye threadably mountable onto exposed upper ends of said threaded members.

17. The device of claim 1 wherein said riser is frustoconically shaped.

18. A method for adjusting the height and inclination of roadway and greenway appurtenances for mounting onto a rigid annular spacer ring sized so as to be mountable onto a manhole, the method comprising the steps of:

mounting an annular retaining un in mating engagement onto the spacer ring.

b) mounting a manhole riser onto said retaining ring so as to sandwich said retaining ring between said riser and the spacer ring, a rigid annular base flange mounted around a base end of said riser, a plurality of threaded bores formed in spaced array around said base flange.

c) threading rigid elongate threaded members into said threaded bores and selectively threadably adjusting said threaded members in said threaded bores so as to protrude downardly from said base flange, beneath said riser, and engage a top surface of said retaining ring, d) adjusting said threaded members in said threaded bores to elevate or to tilt said riser relative to said retaining ring.

* * * * *